US009393705B2

(12) United States Patent
Schmithorst

(10) Patent No.: US 9,393,705 B2
(45) Date of Patent: Jul. 19, 2016

(54) SCISSORS FOR ACCESSING AN ACUTE ANGLE BETWEEN SEWN LAYERS OF MATERIAL

(71) Applicant: Elsa Schmithorst, Terrace Park, OH (US)

(72) Inventor: Elsa Schmithorst, Terrace Park, OH (US)

(73) Assignee: Havel's Inc., Cincinnati, OH (US)

( * ) Notice: Subject to any disclaimer, the term of this patent is extended or adjusted under 35 U.S.C. 154(b) by 191 days.

(21) Appl. No.: 14/259,738

(22) Filed: Apr. 23, 2014

(65) Prior Publication Data

US 2015/0306776 A1 Oct. 29, 2015

(51) Int. Cl.

*B26B 13/06* (2006.01)
*B26B 13/12* (2006.01)
*B26B 29/04* (2006.01)

(52) U.S. Cl.

CPC ..... *B26B 13/06* (2013.01); *B26B 13/12* (2013.01); *B26B 29/04* (2013.01)

(58) Field of Classification Search

CPC ..... B26D 13/00; B26D 13/06; B26D 13/08; B26D 13/10
USPC ..... 30/225–262
See application file for complete search history.

(56) References Cited

U.S. PATENT DOCUMENTS 2,038,916 A 4/1936 Vorwerk
2,249,378 A 7/1941 Di Leo
2,400,220 A * 5/1946 Bell ..... B26B 13/06 30/229
2,801,467 A 8/1957 Casanovas
2,873,526 A * 2/1959 Visconti ..... B26B 13/06 30/254
3,039,191 A * 6/1962 Saxton ..... B23D 29/026 30/258
3,898,734 A * 8/1975 Dorkin ..... B26B 13/06 30/233
4,037,276 A * 7/1977 Brinker ..... B26B 13/00 30/254
4,235,016 A * 11/1980 Kobelt ..... B26B 29/04 30/233
4,250,619 A * 2/1981 Buerkert ..... B26B 13/10 30/230
5,033,195 A * 7/1991 Appelkvist ..... B26B 17/00 30/175
5,421,090 A * 6/1995 Chiou ..... B26B 13/08 30/254
5,499,454 A 3/1996 Compton
5,501,016 A * 3/1996 Kuribayashi ..... B26B 13/20 30/254
5,758,422 A * 6/1998 Frank ..... B26B 13/10 30/230
D417,376 S 12/1999 Schmithorst
D423,894 S 5/2000 Schmithorst
6,129,622 A 10/2000 Seaman et al.
D444,687 S 7/2001 Olix et al.
6,305,088 B1 * 10/2001 Novinger ..... B26B 13/06 30/254
D450,988 S 11/2001 Olix et al.

(Continued)

OTHER PUBLICATIONS

NPL: Scissors for accessing an acute angle http://www.havelssewing.com/applique-scissors-double-pointed-duckbill.html.*

(Continued)

*Primary Examiner* — Jason Daniel Prone
*Assistant Examiner* — Richard Crosby, Jr.
(74) *Attorney, Agent, or Firm* — Wood, Herron & Evans, LLP

(57) ABSTRACT

A scissors for cutting a layer of material having a seam with an acute angle includes a first blade and a second blade. The first blade extends to a first tip and has a first cutting edge. The second blade extends to a second tip and has a second cutting edge and an outer edge. The second blade is operatively connected to the first blade to selectively move between an open position and a closed position. The outer edge includes a linear portion extending from the second tip to a curvilinear portion, which defines a fin. The linear portion and the second cutting edge define an acute angle therebetween.

12 Claims, 9 Drawing Sheets

(56) References Cited

U.S. PATENT DOCUMENTS

| | | | | |
|---|---|---|---|---|
| 6,785,968 | B1 * | 9/2004 | Stevens | B26B 13/10 30/230 |
| 7,116,119 | B2 * | 10/2006 | Sporck | G01R 1/07342 324/754.07 |
| 7,204,022 | B2 * | 4/2007 | Tsuda | B26B 13/26 30/194 |
| 8,677,631 | B2 * | 3/2014 | Hanakawa | B26B 13/06 30/244 |
| 9,113,635 | B2 * | 8/2015 | Yee | A01N 65/00 |
| 2005/0209624 | A1 | 9/2005 | Vijay | |
| 2007/0175047 | A1 * | 8/2007 | Cheng | B26B 29/04 30/233 |
| 2008/0172887 | A1 * | 7/2008 | Potter | B26B 13/22 30/244 |
| 2009/0000129 | A1 | 1/2009 | Nakakoshi | |
| 2011/0240049 | A1 * | 10/2011 | Kim | B26B 13/06 132/200 |
| 2012/0195027 | A1 * | 8/2012 | Russ | B26B 13/06 362/119 |
| 2014/0290071 | A1 * | 10/2014 | Yoshida | B26B 13/06 30/254 |

OTHER PUBLICATIONS

Dictionary.com linear defition: 14259738_NPL_linear_definition.*

Applique Scissors or Duck Bill | NSM—The Sewing Loft, http://thesewingloftblog.com/2013/09/10/applique-scissors-national-sewing-month/, originally printed Sep. 10, 2013 (reprinted Jul. 17, 2014) 4 pages.

* cited by examiner

SCISSORS FOR ACCESSING AN ACUTE ANGLE BETWEEN SEWN LAYERS OF MATERIAL

TECHNICAL FIELD

The present invention relates generally to a scissors, and more particularly, to a sewing scissors for cutting an acute angle of one or more sewn layers of material.

BACKGROUND

Scissors are commonly used in the field of sewing for cutting one or more layers of material, such as a fabric or any other material that may be sewn to another material. While generally any type of scissors may be used for cutting these materials, a variety of specialty scissors have been developed to aid a user, such as a seamstress or tailor, to more effectively cut one or more layers of material depending on a particular pattern of one material sewn to another material. For example, an appliqué scissors, such as a "duckbill" style scissors, is often used by the user to more effectively cut a top layer of material from a base layer of material along a seam. An exemplary common duckbill scissors well known in the prior art is shown in FIG. 6. Specifically, the common duckbill scissors includes a pair of blades in which one of the blades includes an enlarged protrusion, often referred to as a "duckbill," that forces the top layer away from the base layer while the user cuts along the seam. In this way, the user is able to position the pair of blades closer to the seam and, in turn, perform a more accurate and precise cut along the seam of the top and base layers of material.

While common duckbill scissors are generally effective for cutting along seams of various types of patterns including one or more layers of material, the common duckbill scissors is not as effective for cutting a pattern that includes an acute angle between two or more layers of material. More particularly, the large size of the duckbill prevents the common duckbill scissors from cutting along the seam within the acute angle and, in turn, makes acute angle cuts with the common duckbill scissors substantially difficult, if not impossible, to create. For this reason, users resort to another scissors, such as an embroidery scissors not including the duckbill, to cut the acute angle from the pattern. However, because the embroidery scissors is unable to force the top layer away from the base layer while cutting along the seam, the user is more likely to inadvertently cut the wrong layer of material or the seam during use.

There is a need, therefore, for improvements to scissors, and specifically, a need for a scissors for cutting an acute angle of a material sewn to a base material that addresses present challenges and characteristics such as those discussed above.

SUMMARY

According to an embodiment, a scissors for cutting only a first layer of material sewn to a second layer of material with a seam at an acute angle includes a first blade and a second blade. The first blade extends to a first tip and has a first cutting edge extending along the first blade. The second blade extends to a second tip and has a second cutting edge and an outer edge extending along the second blade. The outer edge is positioned opposite the second cutting edge. The second blade is operatively connected to the first blade and selectively movable between an open position and a closed position to cut material therebetween. The outer edge has a linear portion extending from the second tip to a curvilinear portion, which defines a fin. The linear portion and the second cutting edge define an acute angle therebetween.

These and other objects and advantages of the invention will become more readily apparent during the following detailed description taken in conjunction with the drawings herein.

BRIEF DESCRIPTION OF THE DRAWINGS

The accompanying drawings, which are incorporated in and constitute a part of the specification, illustrate embodiments of the invention and, together with a general description of the invention given above, and the detailed description of the embodiments given below, serve to explain the principles of the invention.

DETAILED DESCRIPTION

Figure 1A:
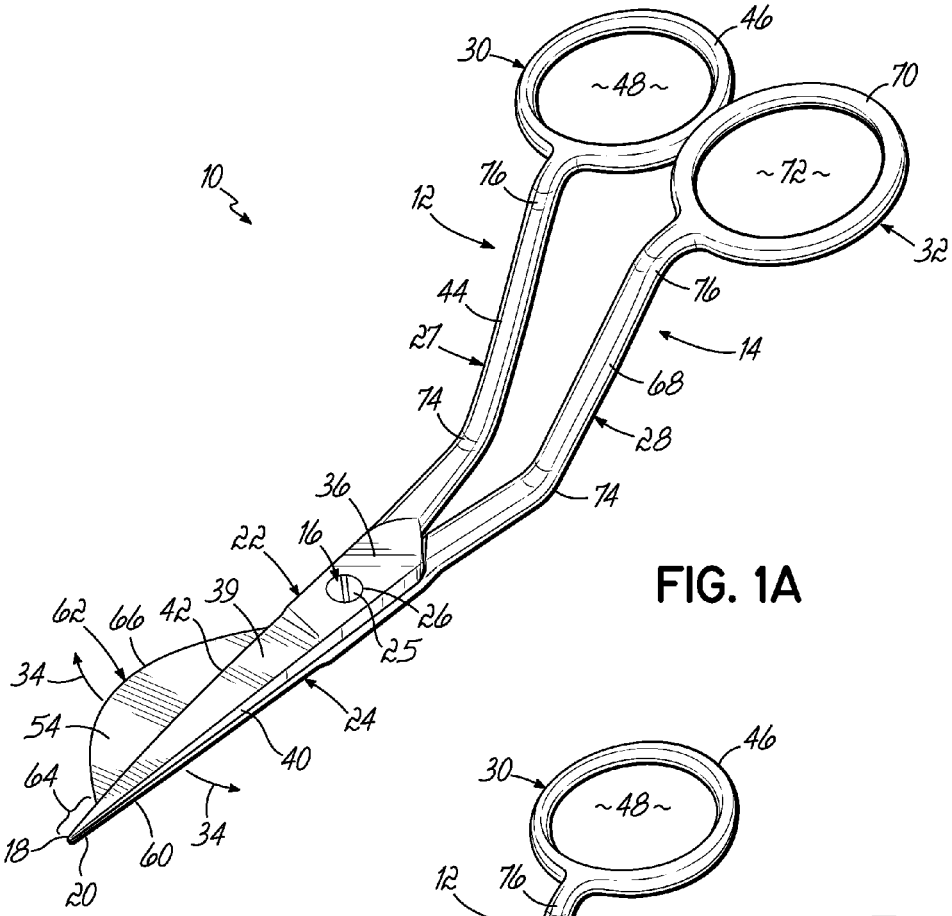
FIG. 1A is a perspective view of a scissors in a closed position according to an exemplary embodiment of the invention.
Figure 1B:
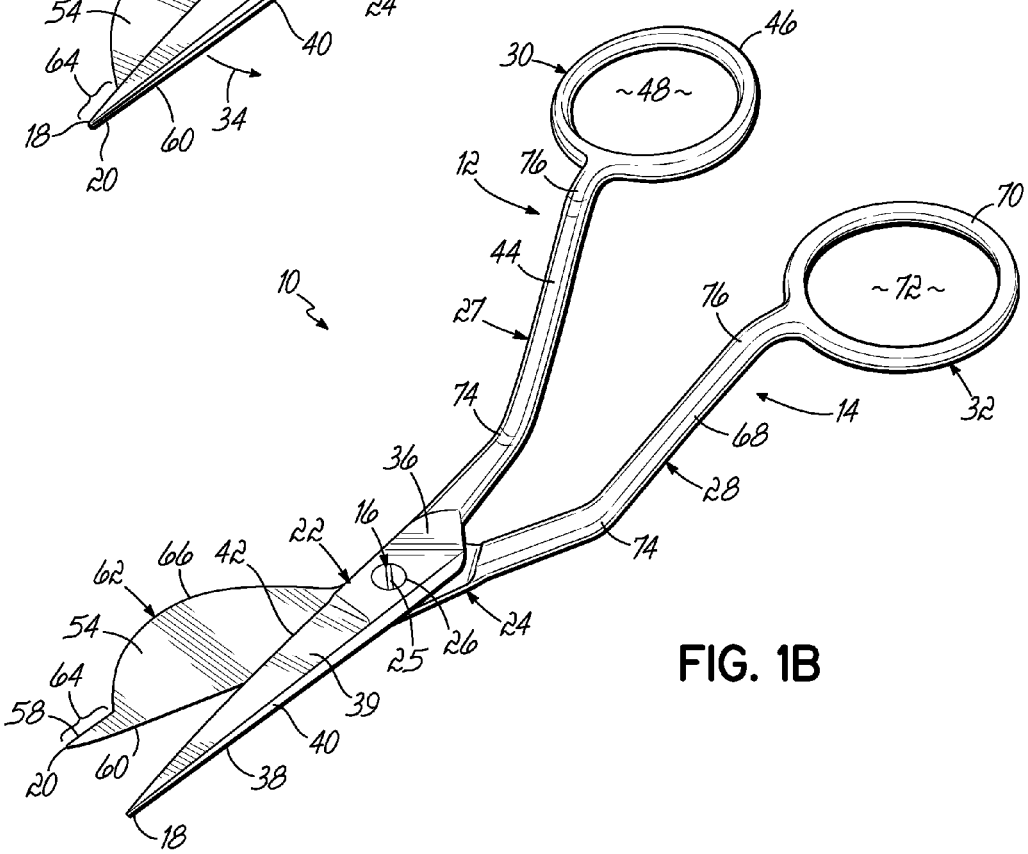
FIG. 1B is a perspective view similar to FIG. 1A showing the scissors in an open position.

With reference to FIGS. 1A and 1B, an exemplary embodiment of a scissors 10 for cutting a layer of material, such as a fabric, while sewing or, more particularly, appliquéing, includes an upper scissor body 12 pivotably connected to a lower scissor body 14 at a fulcrum 16. As described herein and shown in the drawings, the terms "upper" and "lower" are representative of a "right-handed" scissors. However, it will be appreciated that the upper and lower elements of the scissors 10 may be mirrored for a "left-handed" scissors as is well-known in the art. For this reason, the terms "upper" and "lower" are not intended to limit the invention to an exemplary embodiment described herein. Similarly, with respect to the use of the terms "distal," "proximal," "length," and "width" described below, it will also be appreciated that such directions are intended to describe relative locations along exemplary embodiments of the scissors 10. It is not intended that the terms "distal," "proximal," "length," and "width" limit the invention to an exemplary embodiment described herein. The upper and lower scissor bodies 12, 14 each include respective distal tips 18, 20. The blades 22, 24 extend from the tips 18, 20 toward the fulcrum 16 along a length of each scissor body 12, 14. An exemplary embodiment of the fulcrum 16 includes a fastener 25, such as a screw, extending through a bore 26 that similarly aligns with and extends through both blades 22, 24. As such, the blades 22, 24 pivot about the fastener 25.

According to an exemplary embodiment of the scissors 10, the upper and lower scissor bodies 12, 14 further include respective upper and lower handles 27, 28 extending from the fulcrum 16 to gripping portions 30, 32. The gripping portions 30, 32 are generally positioned opposite of the tips 18, 20 and are configured for a user, such as a seamstress or tailor, to hold and operate the scissors 10. For example, the user may grip the scissors 10 in a closed position, as shown in FIG. 1A, separate the handles 27, 28, and pivot the blades 22, 24 about the fulcrum 16, as indicated by arrows 34. As such, the blades 22, 24 are movable to an open position, as shown in FIG. 1B, for receiving a material, such as a layer of fabric. The user may also squeeze the handles 27, 28 together to move the blades 22, 24 toward the closed position, thereby cutting the material between the blades 22, 24 by closing blades 22, 24.

As shown and described herein, the handles 27, 28 are offset from blades 22, 24. However, it will be appreciated that any handle configured to grip the scissor bodies 12, 14 may be used to move the blades 22, 24 between open and closed positions.

Figure 2A:
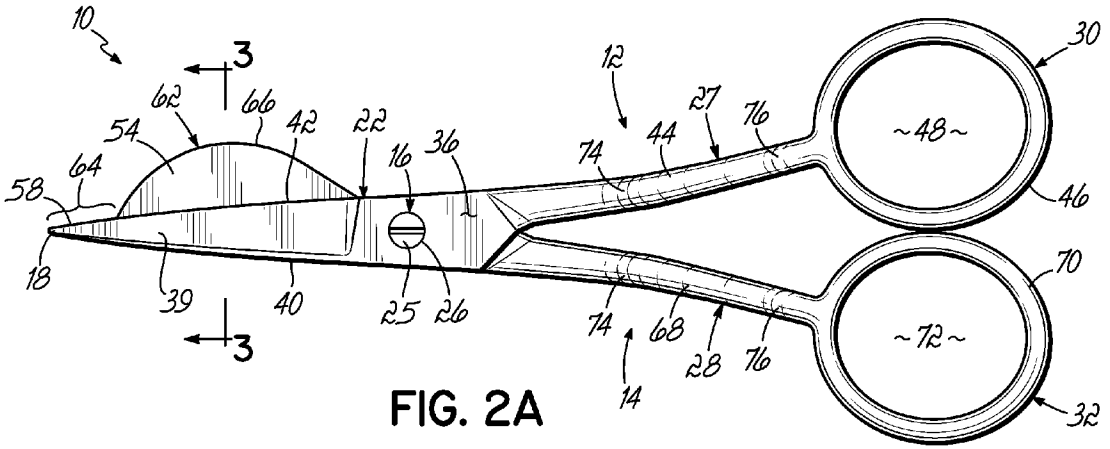
FIG. 2A is a top view of the scissors of FIG. 1A.
Figure 2B:
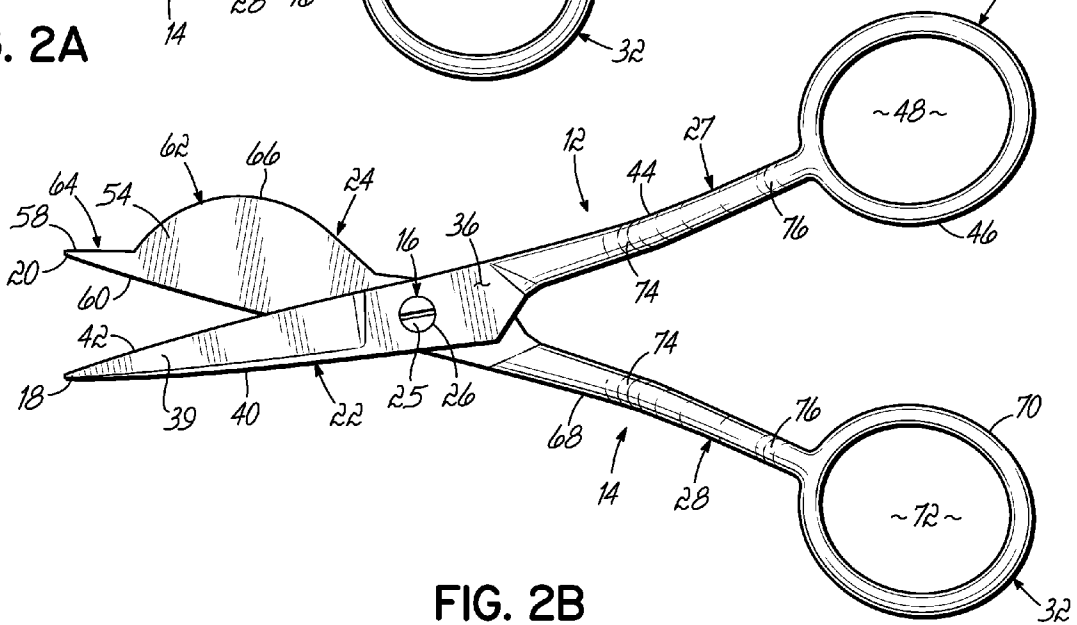
FIG. 2B is a top view of the scissors of FIG. 1B.
Figure 3:
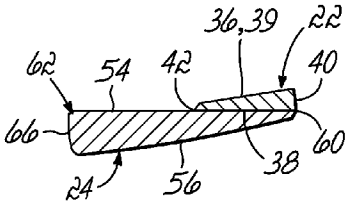
FIG. 3 is a cross-sectional view of the scissors taken along section line 3-3 of FIG. 2A.

As shown in FIGS. 2A-3, the upper blade 22 has top and bottom faces 36, 38. The bottom face 38 is generally planar, whereas the top face 36 includes a beveled portion 39 that tapers from an outer edge 40 toward the cutting edge 42. Furthermore, the outer edge 40 and cutting edge 42 generally intersect at the upper tip 18 at an acute, upper blade angle of between 10 degrees and 20 degrees toward the fulcrum 16. As shown, the upper blade angle is approximately 16 degrees toward the fulcrum 16. As additionally shown, the cutting edge 42 extends along the length of the upper scissor body 12 from the upper tip 18 toward the fulcrum 16 approximately 44 millimeters. It will be appreciated, however, that the upper blade angle and cutting edge 42 may be modified from the embodiment described above to accommodate other angles for cutting.

The upper handle 27 includes an upper handle member 44 that projects from the upper blade 22 to the upper gripping portion 30. The upper gripping portion 30 includes a ring 46. The ring 46 defines an aperture 48 configured to receive a digit of the user, such as a finger.

The lower blade 24 has a generally planar top face 54 and bottom face 56. The bottom face 56 tapers along a width of the lower scissor body 14 from an outer edge 58 toward a cutting edge 60. As such, the bottom face 56 has a reduced profile for positioning the cutting edge 60 relatively close to a layer of material for improved cutting during use. The outer edge 58 extends linearly from the lower tip 20 and then outwardly from the cutting edge 60 to form a generally semi-circular fin 62 projecting away from the cutting edge 60. The fin 62, which may also be referred to as a "duckbill," is configured to urge a layer of material away from the other layer to prevent inadvertently cutting both layers of overlapping material as described below. The outer edge 58 has a linear portion 64, which extends from the lower tip 20 to a curvilinear portion 66. The linear portion 64 of the outer edge 58 and the cutting edge 60 generally intersect at the lower tip 20 at an acute, lower blade angle of between 10 degrees and 20 degrees toward the fin 62. More particularly, the lower blade angle is approximately 16 degrees toward the fin 62, and the cutting edge 42 extends along the length of the lower scissor body 14 from the lower tip 20 toward the fulcrum 16 approximately 44 millimeters. In contrast, the linear portion 64 of the outer edge 58 extends from the lower tip 20 to the fin 62 between 5 millimeters and 15 millimeters. More particularly, the linear portion 64 extends from the lower tip 20 to the fin 62 approximately 8 millimeters. Thus, the fin 64 is offset from the lower tip 20 toward the fulcrum 16 such that the linear portion 64 does not include any portion of the fin 62. Thereby, the linear portion 64 of the lower scissor body 14 is configured to access an acute angle between sewn layers of material.

According to an exemplary embodiment, the fin 62 projects along the width of the lower scissor body 14 to the curvilinear portion 66 of the outer edge 58. The curvilinear portion 66 is generally curved and free of sharp edges to inhibit the fin 62 from catching on one or more materials during use. However, the curvilinear portion 66 intersects the linear portion 64, which linearly tapers from the fin 62 to the lower tip 20. As such, the linear portion 64 of the outer edge 58 relative to the cutting edge 60 defines a maximum width therebetween of approximately 2.6 millimeters. In addition, the curvilinear portion 66 of the outer edge 58 relative to the cutting edge 60 defines a maximum fin width of approximately 17 millimeters. In any case, the maximum width relative to the maximum fin width defines a ratio of approximately 0.15. However, it will be appreciated that the fin 62 may vary in shape, size, and curvature, in accordance with the invention described herein so long as the structure of the fin is configured to urge material from the blades 22, 24 as described below.

Similar to the upper handle 27, the lower handle 28 includes a lower handle member 68 that projects from the lower blade 24 to the lower gripping portion 32. The lower gripping portion 32 includes a ring 70. The ring 70 defines an aperture 72 configured to receive a digit of the user, such as an index finger.

According to an exemplary embodiment shown in FIGS. 1A-1B, the handle members 44, 68 each include an upward bent portion 74 that projects proximally to a downward bent portion 76. The upward and downward bent portions 74, 76 are configured such that the blades 22, 24 are offset from the gripping portions 30, 32. As such, the blades 22, 24 may be positioned against one or more layers of material while the user grips the rings 46, 70 with a hand offset from the material for improved manipulation of scissors 10 during use.

For cutting or otherwise trimming materials, the cutting edges 42, 60 of the blades 22, 24, respectively, are positioned against each other to overlap when moving between the open positions to the closed position for effectively shearing and cutting a layer of material. According to an exemplary embodiment, both cutting edges 42, 60 are sharpened and abut against each other to cleanly cut the layer of material. Alternatively, only one of the cutting edges 42, 60 may be sharpened so long as the material may be effectively cut during use. Thus, it will be appreciated that the cutting edges 42, 60 are not limited to the sharpened cutting edges 42, 60 described herein and the term "cutting edge" may refer to either a sharp edge or a dull edge that shears the material.

FIGS. 4A-4D show a top layer of material 80 sewn to a base layer of material 82 with a seam 84 in a pattern 86 for use during sewing, such as appliquéing. According to an exemplary embodiment, the pattern 86 includes a plurality of acute angles 88 having an acute corner portion 90 adjacent to the seam 84 within the acute angle 88 of the pattern 86.

Figure 4A:
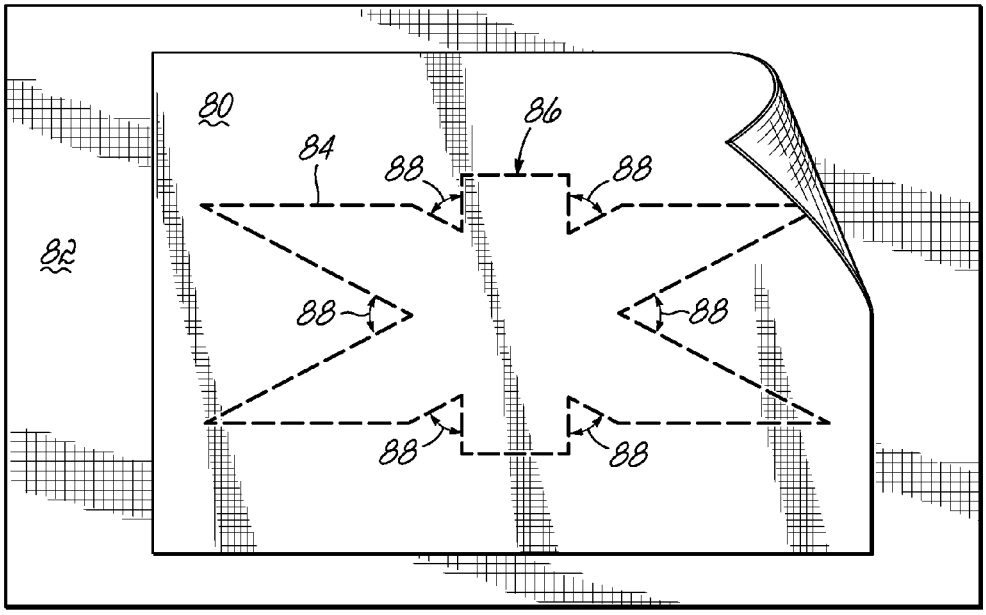
FIG. 4A is a top view of a top layer of material sewn to a base layer of material in a pattern having a plurality of acute angles.
Figure 4B:
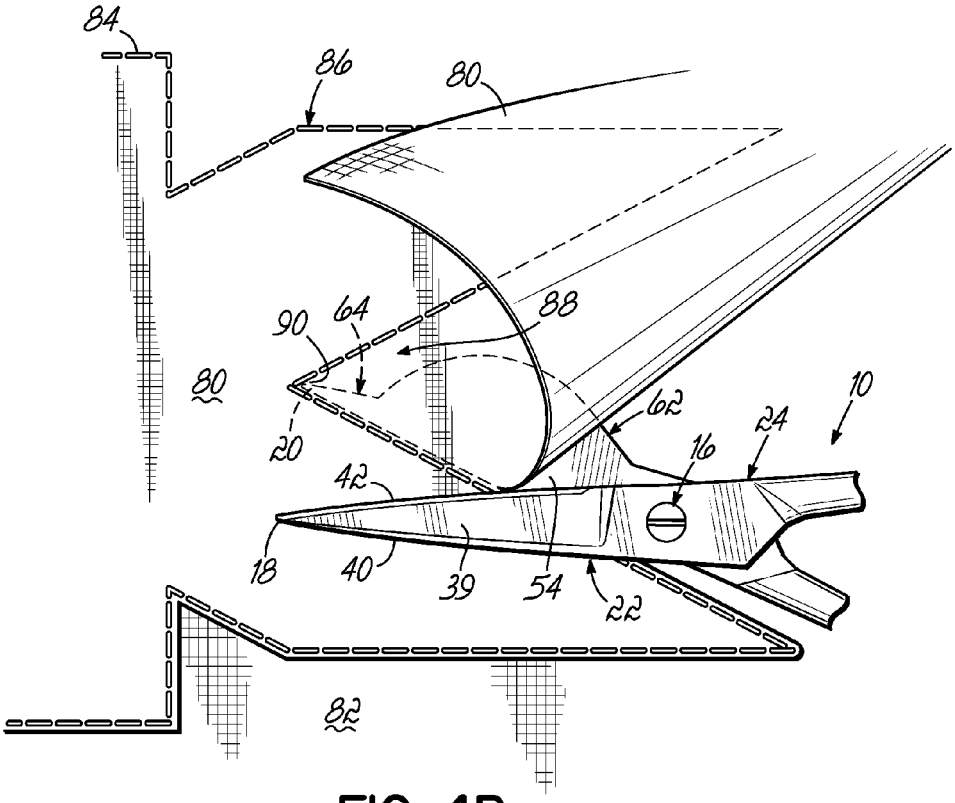
FIG. 4B is an enlarged view similar to FIG. 4A showing the scissors of FIG. 1B positioned adjacent to one of the plurality of acute angles of the pattern prior to cutting the top layer of material.
Figure 4C:
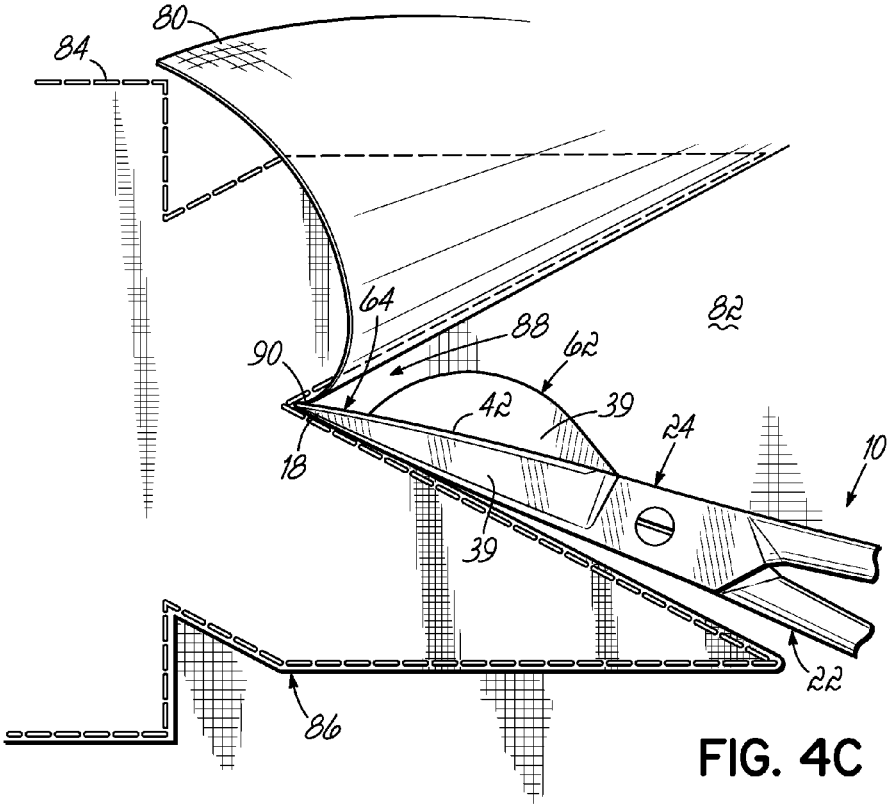
FIG. 4C is an enlarged view similar to FIG. 4A showing the scissors of FIG. 1A positioned adjacent to one of the plurality of acute angles of the pattern after cutting the top layer of material.
Figure 4D:
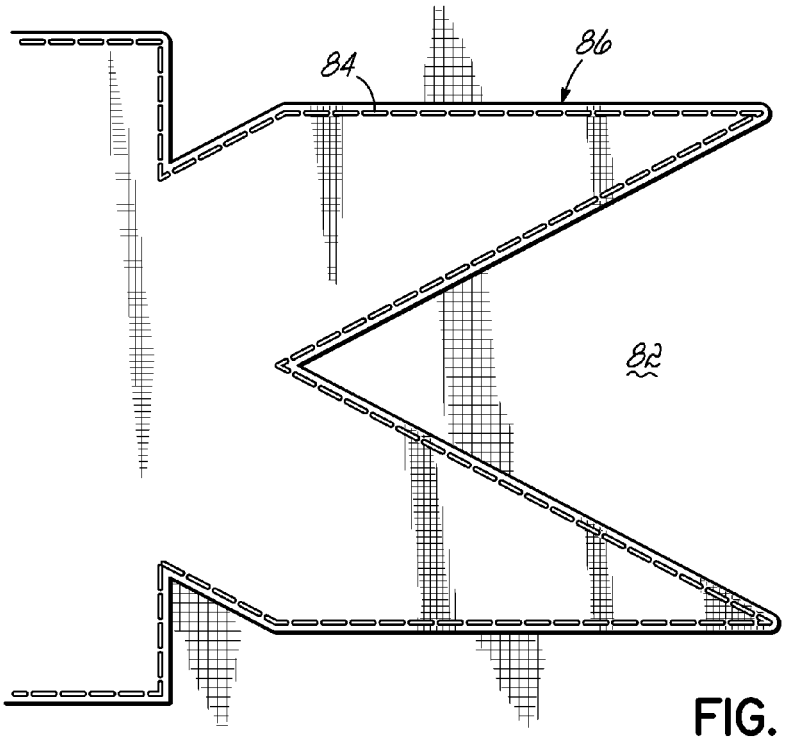
FIG. 4D is an enlarged view similar to FIG. 4A showing a base layer of material and an inner portion of the top layer after removing an outer portion of the top layer with the scissors of FIG. 1A.

In use, the upper blade 22 is pivoted about the fulcrum 16 from the lower blade 24 to the open position shown in FIG. 4B so that the blades 22, 24 receive the top layer of material 80 therebetween. The lower blade 24 is inserted between the top and base layers 80, 82 of material, whereas the upper blade 22 remains above, such as on top of, the top layer of material 80. Due to the dual features of the linear portion 64 and the curvilinear portion 66 of the outer edge 58, the fin 62 urges the top layer of material 80 away from the base layer of material 82 to inhibit inadvertently cutting the base layer of material 82, while the lower tip 20 abuts the seam 84 within the acute corner portion 90. More particularly, the lower tip 20 abuts the seam 84 within the acute corner portion 90 simultaneously with the curvilinear portion 66 urging the top layer of material 80 away from the base layer of material 80. Accordingly, the user squeezes the rings 46, 70 together to pivot the upper blade 22 toward the lower blade 24, relatively, and cut the top layer of material 80 directly adjacent to the seam 84. The placement of the scissors 10 and cutting of the top layer of material 80 may then be repeated for each acute angle 88 of the pattern 86.

Figure 5:
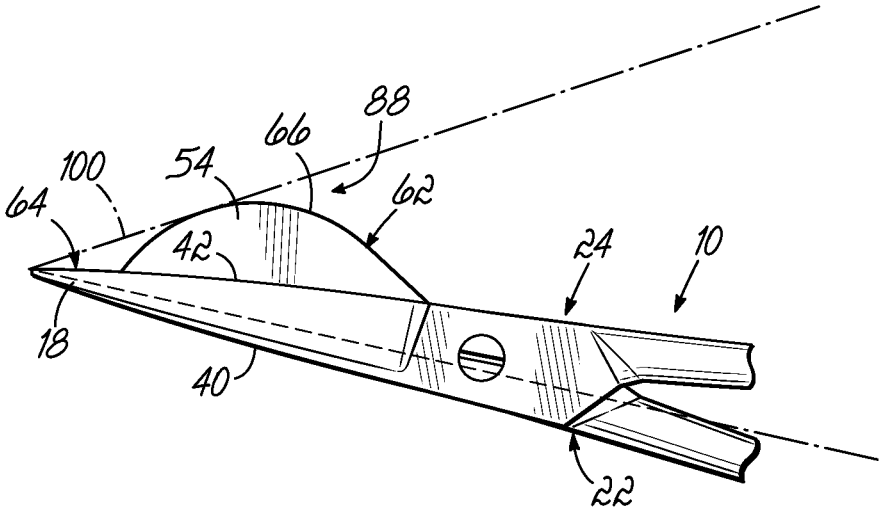
FIG. 5 is an enlarged view of FIG. 2A.
Figure 6:
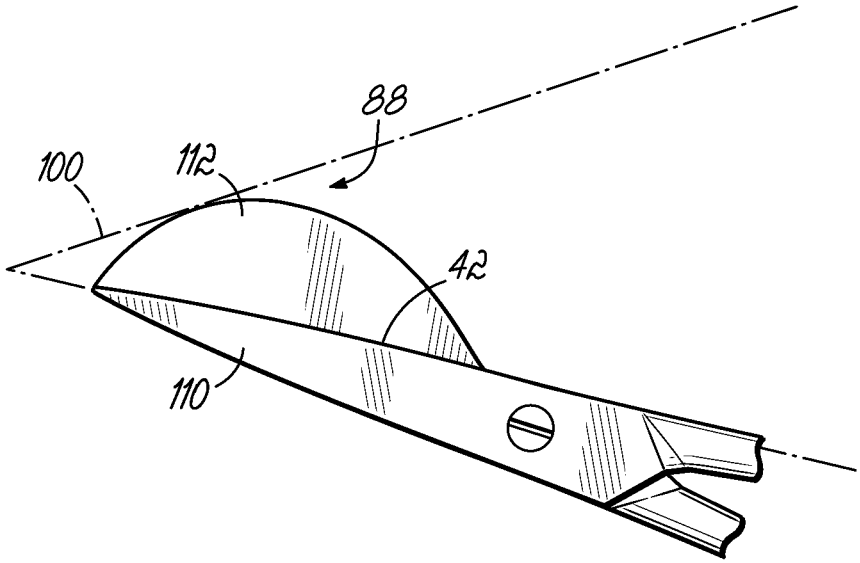
PRIOR ART FIG. 6
FIG. 6 is an enlarged view of a traditional duckbilled scissors known in the prior art.
Figure 7:
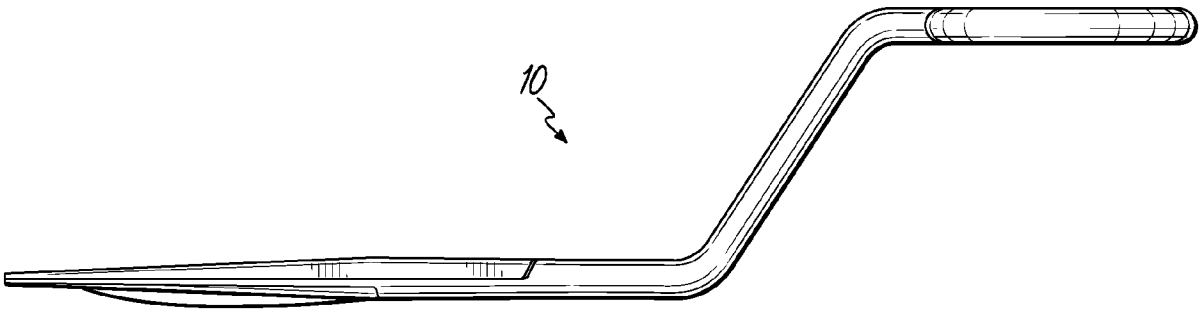
FIG. 7 is a right side view of the scissors of FIG. 1A.
Figure 8:
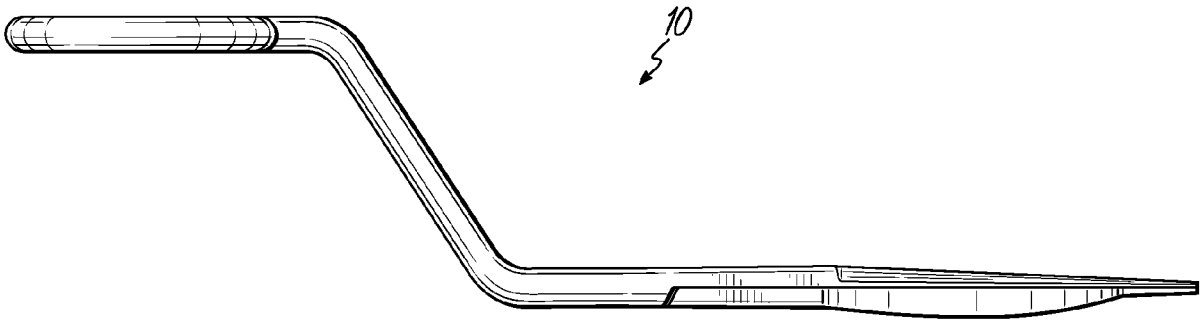
FIG. 8 is a left side view of the scissors of FIG. 1A.
Figure 9:
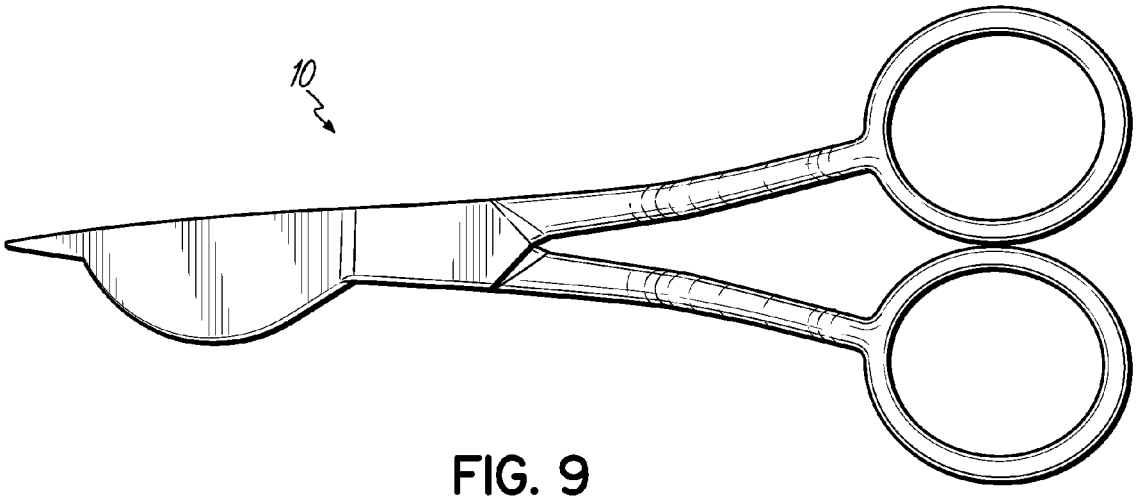
FIG. 9 is a bottom view of the scissors of FIG. 1A.
Figure 11:
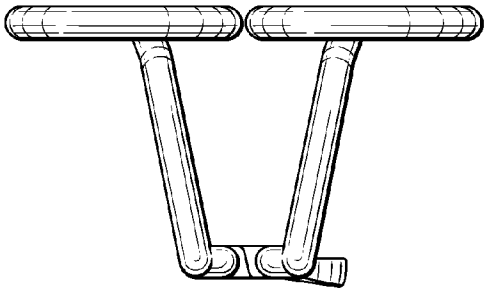
FIG. 11 is a rear view of the scissors of FIG. 1A.
Figure 10:
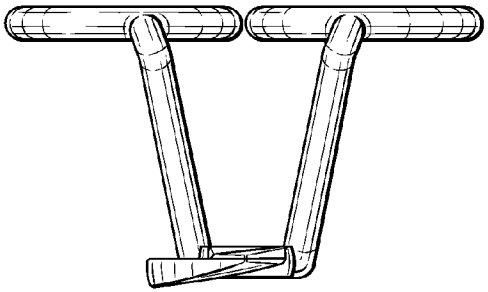
FIG. 10 is a front view of the scissors of FIG. 1A.
Figure 12:
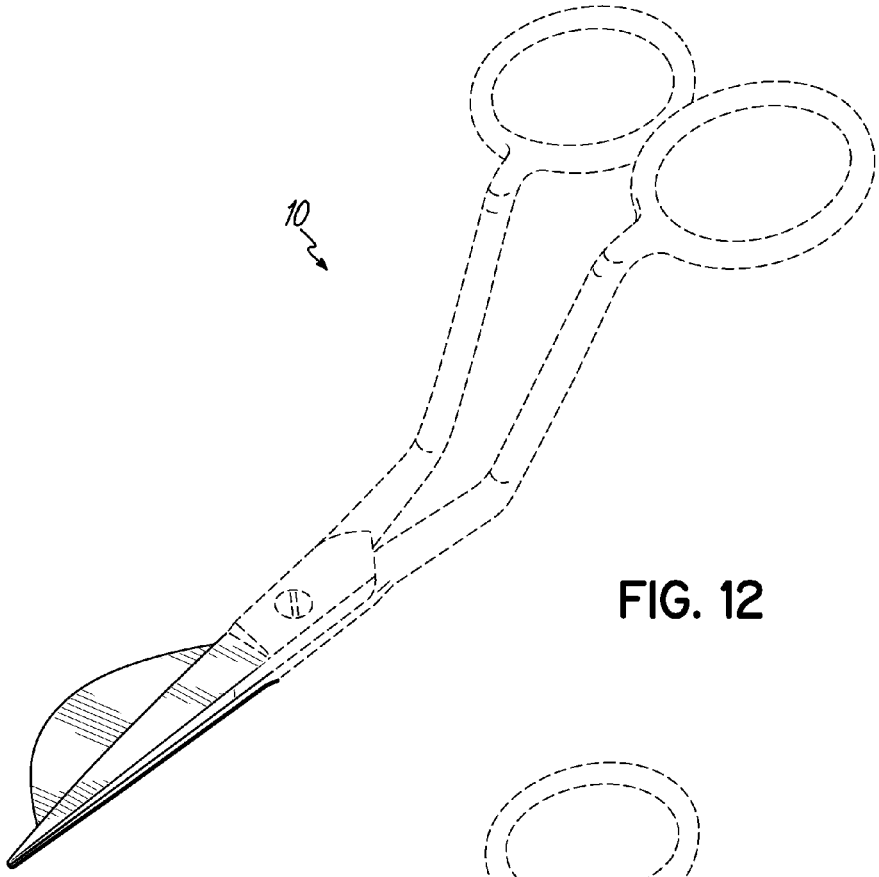
FIG. 12 is a perspective view similar to FIG. 1A showing a linear portion of the scissors in a closed position.
Figure 13:
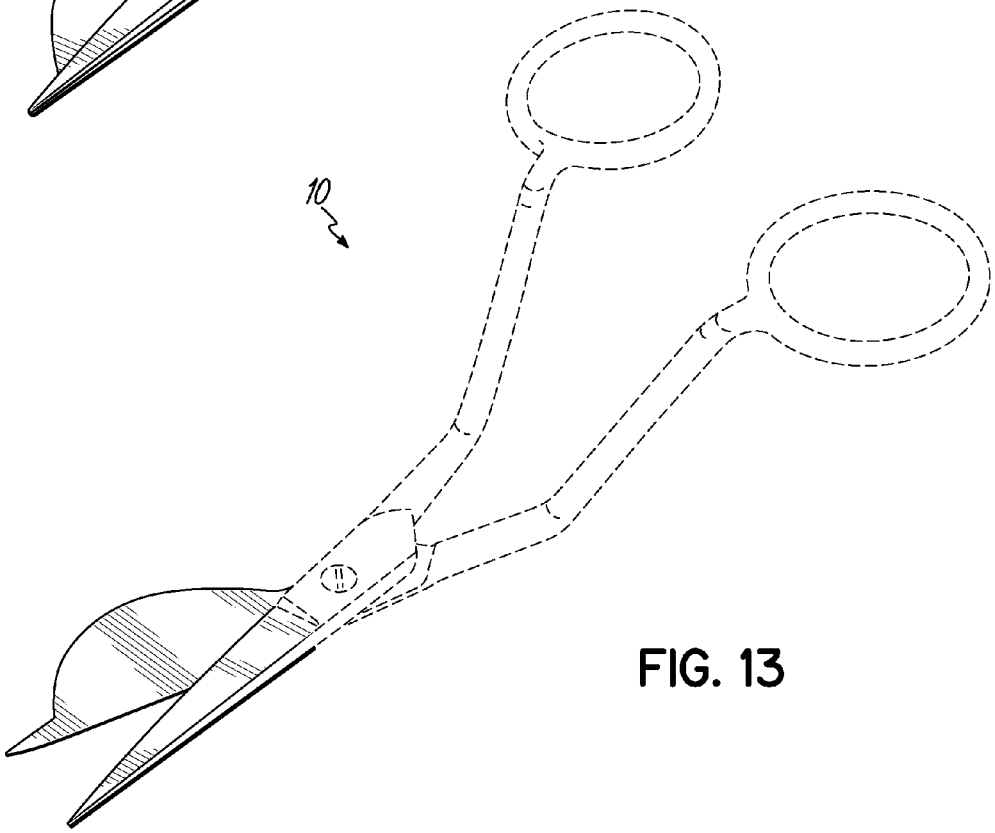
FIG. 13 is a perspective view similar to FIG. 1B showing a linear portion of the scissors in an open position.
Figure 14:
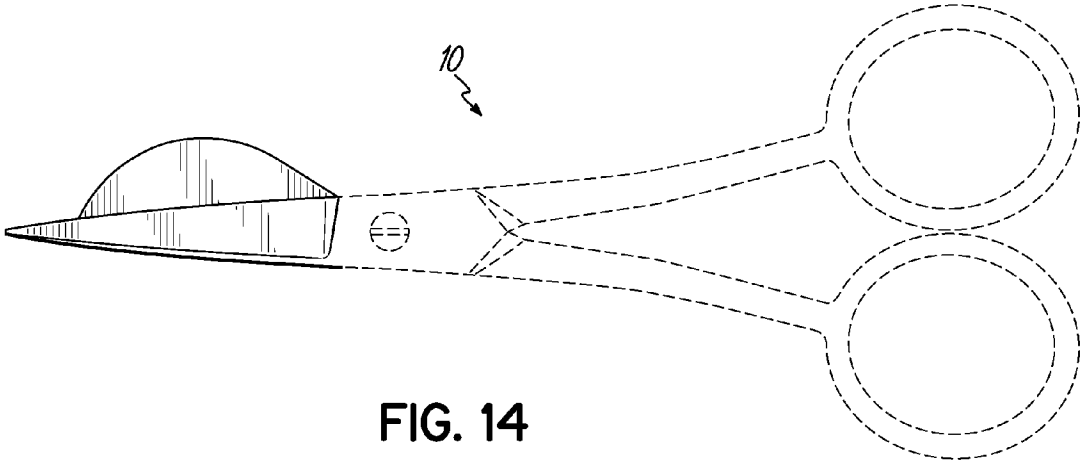
FIG. 14 is a top view of the linear portion of the scissors of FIG. 12.
Figure 15:
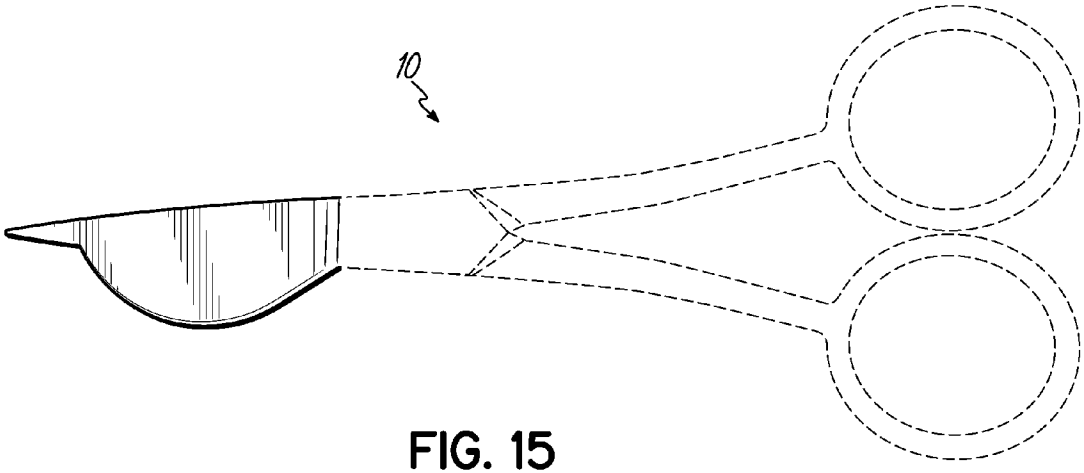
FIG. 15 is a bottom view of the linear portion of the scissors of FIG. 12.

FIGS. 5-6 show an exemplary embodiment of the blades 22, 24 and a traditional duckbilled scissors having an upper blade 110 and a lower blade 112 as is well known in the prior art. As shown in FIG. 6, the blades 110, 112 fail to accurately and precisely cut against the seam, because the lower blade 112 defines a relatively large inclusive angle. In contrast, the lower blade 24 of FIG. 5 defines a relatively small outer edge angle 100 between the cutting edge 60 and the curvilinear portion 66 of the outer edge 58 of less than 45 degrees. More particularly, the outer edge angle 100 is less than 30 degrees. As described above, the linear portion 64 defines the lower blade angle from the cutting edge 60 to the outer edge 58 of the linear portion 64 of approximately 16 degrees. As such, according to an exemplary embodiment, the lower blade 24 is configured to be inserted within an acute angle defined by an acute seam of at least 30 degrees. Moreover, the linear portion 64 is configured to be inserted within an acute corner portion of an acute angle of at least 16 degrees for accurately and precisely cutting against the seam. However, it will be appreciated that the blades 22, 24 may be alternatively configured for accessing other acute angles. For example, the length of the linear portion 64 may be extended and/or the width of the curvilinear portion 66 and fin 62 may be reduced for accessing smaller acute angles.

While the present invention has been illustrated by a description of an exemplary embodiment and while this embodiment has been described in some detail, it is not intended to restrict or in any way limit the scope of the appended claims to such detail. Additional advantages and modifications will readily appear to those skilled in the art. The various features of the invention may be used alone or in any combination depending on the needs and preferences of the user. This has been a description of an embodiment of the present invention. However, the invention itself should only be defined by the appended claims.

What is claimed is:

1. A scissors for cutting a first layer of material sewn to a second layer of material with a seam at an acute angle, comprising;

a first blade extending to a first tip and having a first cutting edge extending therealong; and a second blade extending to a second tip and having a second cutting edge and an outer edge extending therealong, said outer edge positioned opposite said second cutting edge, said second blade pivotally connected to said first blade at a fulcrum and wherein said first and second cutting edges are linear from proximate said fulcrum to said first and second tips, respectively, wherein said first and second blades pivot between an open position for receiving the first layer of material between said first and second cutting edges and a closed position, said outer edge having a curvilinear portion and a linear portion, said linear portion extending from said second tip of said second blade to said curvilinear portion, said curvilinear portion defining a fin, said linear portion and said second cutting edge defining an acute angle therebetween.

2. The scissors of claim 1, wherein said acute angle is between 10 degrees and 20 degrees.

3. The scissors of claim 2 wherein said acute angle is approximately 16 degrees.

4. The scissors of claim 1, wherein said linear portion has a length between 5 millimeters and 15 millimeters.

5. The scissors of claim 4, wherein said length is approximately 8 millimeters.

6. The scissors of claim 1, wherein said linear portion relative to said second cutting edge defines a maximum width, said fin relative to said second cutting edge defines a maximum fin width, and said maximum width relative to said maximum fin width defines a ratio of approximately 0.15.

7. The scissors of claim 1, wherein said linear portion and said second cutting edge define a maximum width therebetween of approximately 2.6 millimeters.

8. The scissors of claim 1, further comprising:

a first handle extending proximally from said first blade and a second handle extending proximally from said second blade, said first and second handles configured to be gripped by an user.

9. The scissors of claim 1, wherein said second cutting edge and the said fin inclusively define an outer edge angle of less than 45 degrees.

10. The scissors of claim 9, wherein said outer edge angle is less than 30 degrees.

11. The scissor of claim 1, wherein the second blade includes a bottom face, and said bottom face is tapered for positioning the cutting edge adjacent to the second layer of material.

12. The scissors claimed in claim 1 wherein said fin projects upwardly away from said first cutting edge to form a generally semicircular fin.

* * * * *